US006394363B1

(12) United States Patent
Arnott et al.

(10) Patent No.: US 6,394,363 B1
(45) Date of Patent: May 28, 2002

(54) LIQUID PROJECTION APPARATUS

(75) Inventors: Michael George Arnott; Simon Roger Johnson; Victor Carey Humberstone; Richard Wilhelm Janse Van Rensburg, all of Cambridgeshire (GB)

(73) Assignee: The Technology Partnership PLC, Rayston (GB)

( * ) Notice: Subject to any disclaimer, the term of this patent is extended or adjusted under 35 U.S.C. 154(b) by 0 days.

(21) Appl. No.: 09/673,384

(22) PCT Filed: Apr. 16, 1999

(86) PCT No.: PCT/GB99/01164

§ 371 (c)(1),
(2), (4) Date: Oct. 17, 2000

(87) PCT Pub. No.: WO99/54140

PCT Pub. Date: Oct. 28, 1999

(30) Foreign Application Priority Data

Aug. 17, 1998 (GB) ..... 9808182

(51) Int. Cl.[7] ..... B05B 1/08; B05B 3/04; B05B 1/14; F23D 14/68

(52) U.S. Cl. ..... 239/102.1; 239/102.2; 239/553.3

(58) Field of Search ..... 239/102.1, 102.2, 239/304, 305, 438, 456, 536, 549, 551, 554, 555, 568, 553.3; 347/46, 47, 68, 69, 70; 134/1.3, 2, 3, 26, 28

(56) References Cited

U.S. PATENT DOCUMENTS

| | | | | | |
|---|---|---|---|---|---|
| 5,518,179 | A | * | 5/1996 | Humberstone et al. | 239/102.2 |
| RE35,737 | E | * | 2/1998 | Sourlis et al. | 347/47 |
| 5,798,771 | A | * | 8/1998 | Nishii et al. | 347/7 |
| 5,831,650 | A | * | 11/1998 | Reinten | 347/68 |
| 5,877,789 | A | * | 3/1999 | Reinten | 347/48 |
| 5,964,958 | A | * | 10/1999 | Ferrell et al. | 134/26 |

* cited by examiner

*Primary Examiner*—Henry C. Yuen
*Assistant Examiner*—Davis Hwu
(74) *Attorney, Agent, or Firm*—Dykame Gossett PLLC

(57) ABSTRACT

The present invention relates to liquid projection apparatus in the form of a face-shooter array. Material layers are used as the basis to fabricate the device to overcome constructional difficulties associated with other technologies. The device utilizes excitation of the surface layers (100) incorporating nozzles (8) which are arranged over one surface layer with addressability, forming a liquid projection array, capable of operation at high frequencies with a wide range of liquids.

20 Claims, 12 Drawing Sheets

LIQUID PROJECTION APPARATUS

Figure 1A:
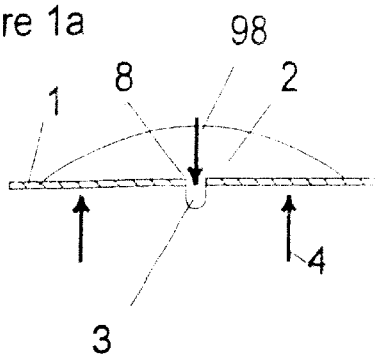

The present invention relates to liquid projection apparatus in the form of what is known as a 'face-shooter' array.

In the ink-jet art there are many liquid projection devices that utilize the acoustic resonance of capillary channels or chambers, hereinafter collectively termed 'cells', associated with nozzles to provide a pressure wave to cause liquid to be expelled from those nozzles. These technologies are limited in their maximum frequency of operation by the liquid acoustic resonant frequency of these cells. In addition to this, the cells act as a restriction to flow causing pressure to be developed within the cells which effects drop ejection. Flow through the cells is therefore limited by the refill rate, causing a further upper limit to the operational frequencies of such devices. Moreover, the cells act as a trap for air bubbles and contaminant particles that severely disrupt operation and which are problematic to remove. Structures employing cells are also thereby restricted to handling liquids of particular rheology, high purity and stability. For example, unstable suspensions that are used to form white, gold and silver inks cannot be applied reliably with devices employing cells.

Further technologies described in the art provide excitational members in the bulk liquid in close proximity to the rear of a separate nozzle-plate. This configuration has the advantage of allowing bubbles to escape, but the method is intrinsically inefficient in use of energy and prone to crosstalk.

A further difficulty associated with printheads known in the art is that their construction is based on sub-assembly onto a three dimensional structure rather than onto a substantially two dimensional workpiece. This has the consequences of increasing the variability of the product and decreasing the manufacturing yield.

In the ink-jet industry, there is an unfulfilled requirement for printheads that can be fabricated with a sufficient number of ejection sites on a single printhead to constitute a page-wide array. The problem of producing such a printhead is the requirement that the fabrication processes must provide a structure with a high degree of consistency between thousands of ejection sites. Predominantly in the prior art, for example EP0728583A2, constructions are taught wherein there is a requirement to locate a number of components in three dimensions to form a linear drop on demand ink-jet printhead. This construction does not achieve the integration of the transducer means into a substantially planar form. It is the belief of the authors of the current invention that this lack of integration is the prime limitation on the width of the array that can be constructed by methods in the prior art.

The same construction difficulty arises in WO-A-94/22592 wherein excitation means are bonded to, but not integrated with, a material layer in which nozzles are formed. This prior art also requires an extended structure behind the nozzle-plate to provide the acoustic energy to enable drop production. The fabrication of this prior art must also proceed by fabrication in three dimensions, again introducing problems of component alignment.

As stated above, the inventors believe the solution to this problem is to understand that the extended construction can be achieved by integrating the transduction means to the surface. In practice, achieving this is not a trivial problem to overcome.

For example, if the structures disclosed in WO-A-94/22592 are reduced in height to achieve the substantially planar condition, a contradiction results. Firstly, the motional action of the PZT (piezoelectric lead zirconate titanate ceramic) as configured, reduces markedly with PZT height reduction. Secondly, the structure requires the surface to flex, but the PZT must remain rigidly bonded to a further surface. The structure cannot be reduced to a layer.

A second approach is to apply an annular ring geometry, such as is described in our EP-A-0615470, to form a surface array of such devices. If the flexural rings are set out and connected in an array there is first a problem of scale; the separation of nozzles on the array will be determined by the minimum achievable PZT ring outer diameter that will produce droplets at an acceptable drive voltage. This will be too large to form a high resolution linear array (such as 150 nozzles per inch, as is required, for example, in many printing applications). An attempt to apply the vibration of a surface (bimorph) flexural ring is disclosed in JP 09-226111. However in this case the rings being bonded to, or formed in, a material layer are unavoidably coupled around the outer circumference to the material layer as a whole, inducing undesirable crosstalk between rings.

An alternative form of excitation, from a similar physical structure to JP 09-226111, is shown in JP 10-58672. In this patent application, the radial vibration of a surface ring is apparent. Again, however, the rings are unavoidably coupled around their outer circumference to the material layer as a whole, inducing undesirable crosstalk.

A subsequent patent application, JP 10-58673, also discloses an annular ring geometry employed to produce a surface meniscus resonant wave. The inventors of JP 10-58673 seek to improve fluid coupling by introducing a further structure at a defined depth of ink beneath the nozzle, forming a flow constriction which effectively defines a resonant cell structure, and thereby the substantially planar condition of construction is lost.

In the prior constructions taught in JP 09-226111, JP 10-58672, JP 10-58673, the droplet formed is small compared to the 'nozzle' opening of the substrate. The relatively large nozzle is correspondingly more sensitive to undesirable wetting of the front face of the printhead than the constructions in which an issuing jet fills the nozzle to produce a droplet of similar size, for example under conditions of ink having low surface tension or physical shock to the printhead. This sensitivity arises from the lower pressure differences that the relatively larger diameter meniscus within the larger 'nozzle' can sustain.

According to the present invention there is provided a device for projecting liquid as jets or droplets from multiple nozzles, the device comprising;

- a plurality of transducers oriented substantially parallel to one another and each having an inner face and an outer face opposite said inner face, the transducers being arranged in a substantially planar array;
- a plurality of nozzles, each nozzle being associated with a respective transducer which is excitable to cause movement of the associated nozzle in a direction substantially aligned with the nozzle axis, to project liquid therefrom;
- liquid supply means for supplying a liquid to said inner face of said nozzles;
- means for selectively exciting transducers as required, thereby to project liquid as jets or droplets from the respective outer face by movement of the liquid through the nozzle in response to the movement of the nozzle.

Thus, in such a device, the transducers are all aligned in the same direction and, where the transducers are rectilinear, they all have a major axis parallel with that of the other transducers. Even where the transducers are not rectilinear, as long as they are congruent, they will have at least one edge in parallel with the same edges of other transducers in the array.

By the term "transducer" is meant a local region of the liquid projection device that can be stimulated into motion by an associated individually-addressable excitation means. By the term "substantially planar" it is meant that the height of the components is small with respect to the lateral extent of the array of individual components.

The inventors believe the key to achieving a page-wide array is making the array in layers which may be aligned optically using surface processing techniques.

The transducer components may be formed in one piece comprising, for example, a piezoelectric or similar excitation means. The transducers may also be formed as a composite component in which an excitation means is, for example, bonded to or formed integrally with one or more other material bodies which may, for example, provide a mounting support or substrate for the excitation means.

It is not necessary that all transducers have nozzles associated with them. However, for those transducers that do have associated nozzles, the nozzles may pass through the exciting means or through the material body (or bodies) that, together with the exciting means forms the composite transducer or through both the exciting means and that material body (or bodies). In each case the transducer surfaces that each nozzle intersects in passing therethrough define the inner and outer faces of that transducer. Correspondingly, in this specification, implementations of the invention in which a nozzle (or nozzles) is formed in a separate component from that to which excitation is directly applied are together considered to comprise the transducer.

Preferably the excitation means, and associated material body (or bodies) if used, that form the transducer are in the form of layers. Forming the transducers of the projection device from layer components in this way allows accurate registration of their component parts to be more easily and reliably achieved in assembly of the liquid projection device than is achieved with the three-dimensional constructions prevalent in the prior art.

Distinct transducer regions may be formed within the material layer by selective thinning of the layer, allowing the respective region to move with reduced constraint from the remainder of the material layer and thereby enhancing transducer operation. A further reduction in constraint can be achieved by slitting right through the material layer to form slits around each transducer region. The regions may thus be in the form of beams formed by slits within or through the material layer, and each of the slits may be sealed. Furthermore, the slits may be arranged in the form of a comb or in the form of two interdigitated combs.

In the prior art slits were included simply to enable bending to take place and the have to be thin otherwise they will leak—so they are a mixed blessing. We have turned the problem to our advantage by using the slits not only as a means of getting the bending, but also as a method of suppressing crosstalk—so the slits become isolation means decoupling the transducers. The isolation can be improved by filling the slits with a compliant medium, and this overcomes the leakage problem. The slits may be of comparable width to the transducer as the compliant medium allows the separation to be chosen to get the isolation needed.

Decoupling is thus achieved by separating the transducers by substantially parallel gaps within or through the surface, with the principal constraint and contact of the transducers to the bulk of the material layer adjacent to the distal ends of those gaps, and preferably with the greatest amplitude of transducer motion proximal to a nozzle opening (preferably located distant from those distal ends) which ejects the liquid (typically ink). Further, the physical separation allows a second material to be used to fill the space between the transducers. If this is chosen to be a compliant rather than a stiff medium, excellent decoupling can be achieved. Alternatively a compliant sealing layer may be used to seal the space, again maintaining excellent decoupling. The use of slits to divide flexural nozzle-plates is disclosed in WO-A-94/22592, but a planar array of transducers bearing nozzles is not taught, and the width of the slits is restricted by the tendency of the liquid to seep or be pumped to the outer surface during filling and drop firing respectively. In the present invention, nozzle-plate motion is induced by flexural, rather than extensional, elongation of rigid rods, as in WO-A-94/22592 Therefore, in the present invention, the mechanical properties, e.g. stiffness, of the nozzle-bearing layer are comparable to those of the 'excitation means' layer, helping to maintain co-planarity of adjacent nozzle-bearing transducers. This helps both to prevent liquid egress through unsealed slits and, in the case of sealed slits, helps retain motional excitation to produce droplets with low or acceptable levels of crosstalk carried by the sealing means. The use of sealing means for liquid sealing without introducing substantial crosstalk is therefore one aspect of the current invention.

The layer-surface may be utilised as part of the transducer means, selectively decoupled from the extended material layer to suppress crosstalk and configuring the excitation means within this transducer to function jointly in the bending mode. Further, this new layer-surface approach allows the use of nozzles of dimension smaller than the diameter of ejected droplets (and with good resistance to blocking in the case of suspension liquids such as pigmented inks), so avoiding the sensitivity to 'wetting-out' shown by the prior art devices.

In one construction arising from the invention the transducers may comprise three material layers, each optimized for their function, for example; a first layer of piezoelectric material providing the excitation means and which is mounted on a second support layer of (for example) stainless steel sheet that cooperates with the piezoelectric layer to provide flexure and which in turn carries on its opposite face a third thin polymer layer, in which the liquid-ejection nozzles are formed. Alternatively, such functions may be combined into two or even one layer.

For those transducers bearing nozzles, we term the local vicinities of the nozzles of those transducers as the 'nozzle regions'. In use, liquid present at a nozzle region at the inner face of a transducer passes through the nozzle to be projected as a jet or droplet (or plurality of jets or droplets) when the transducer is excited such that at least the nozzle region moves (with appropriate amplitude and response time) in a direction substantially aligned with the nozzle axis. Most conveniently both the nozzle axis and the motion of the nozzle region is in a direction substantially parallel to the surface normal of the nozzle-bearing region of the transducer.

The nozzles within the nozzle bearing regions are arranged in an array within the device, which array may be one-dimensional such as a row or a line of nozzles, or may be two-dimensional such as multiple rows or lines preferentially arranged parallel to each other. Such a nozzle array ensures that there is an array of, at least, nozzle-bearing transducers. In addition, within that array may be additional transducers without nozzles (for example interspersed with the nozzle-bearing transducers). These additional transducers can be helpful in suppressing residual crosstalk-induced layer resonances and layer edge effects.

In preferred embodiments of the invention at least those transducers bearing the nozzle-bearing transducers are individually addressable. It is usually desirable that the motion of one nozzle bearing transducer (excited to eject liquid from its corresponding nozzle(s)) does not cause comparable motion of other nozzle-bearing transducers or substantial pressure fluctuations in liquid adjacent nozzle-bearing regions of other transducers. In this way, not only are the nozzle-bearing transducers individually addressable, but in addition individual control of liquid projection may be obtained from each nozzle-bearing transducer and, where each such transducer includes only one nozzle, individual control of ejection from each nozzle is obtained. We refer to this generally as reducing 'crosstalk' between nozzles (and/or nozzle-bearing transducers).

The array of transducers referred to above, and/or any of their constituent parts (such as excitation means, support body for excitation means and/or nozzle-bearing body) may be integrally formed with one another or else may be individually formed. If integrally formed then, to reduce crosstalk mediated through the solid elements of the device ('mechanical crosstalk'), it is generally desirable to separate or partially separate them by gaps, typically in the form of slits. The gaps may extend through one, several or all component layers of the transducers (for example through just the exiting means and its support body but not through a thin polymer nozzle-bearing layer).

In the case that the slits or gaps extend through all those components that otherwise provide a slit between inner and outer face of the transducer it is generally advantageous to seal those slits or gaps against liquid egress or evaporation. This may be done, for example, by incorporating into the slit a soft elastic material body that is poor at transmitting transducer motion parallel to the slit, such as Latex Solder Resist as supplied by RS, part number 561549. Alternatively a further material layer (or layers) (which can be considered, to the extent that it contributes to transducer operation as a further transducer component; and which can be considered, to the extent that it influences only overall device performance, as a common component for all the transducers that it seals in this way) can be applied across the slits thereby to seal them. This further material layer may be formed of, for example, 25 micron polyimide sheet such as Upilex.

Therefore, in favoured implementations of the present invention, there is provided a material layer or layers bearing nozzles and which are excited into motion with respect to bulk liquid brought to them. This action induces pressure excursions in the bulk liquid in nozzle regions of transducers. Each transducer bearing a nozzle is individually excited into motion ('individually addressable'), and the invention allows simple construction of such individually addressable multi-nozzle droplet dispensing devices.

This invention aids the reduction of mechanical crosstalk between nozzles, thereby aiding individual control of liquid ejection from each nozzle as well as providing individually addressable transducers.

Devices according to the invention may with advantage provoke both positive and negative excursions of such liquid pressure at least in nozzle-bearing regions to project liquid from the said nozzle. The 'motional nozzle' method does not rely upon low compressibility of the liquid or upon stiff cells and so contrasts with conventional ink-jet droplet dispensation apparatus wherein pressure is generated compressively within the cells.

The current invention provides 'direct' excitation of the nozzle region ('direct' in this sense meaning that the excitation is not primarily transmitted to the nozzle region by using the liquid as the transmission medium. Rather, it is primarily transmitted via the solid material components of which each respective transducer is formed. In this way a device according to the invention causes the greatest pressure excursions to be produced in the nozzle-bearing region immediately behind the nozzle, this advantageously thereby reduces 'liquid crosstalk' mediated by the liquid. By 'liquid crosstalk' we mean energy transfer via the liquid from the nozzle region of one transducer to the nozzle region of another transducer (otherwise, potentially making an undesirable contribution to liquid ejection also from that other nozzle).

A unique advantage of devices according to the present invention over devices in the prior art is that the individual addressability and commonality of substrate of the transducers advantageously permit active cancellation of residual crosstalk signals from one local region by the partial or phased (or both) activation of neighbouring transducers. This results in the ability to operate next nearest neighbour local regions synchronously, using the intervening transducers (which may have no nozzles) to actively damp crosstalk.

The integration of the excitation and nozzle means and the motional excitation mechanisms also reduces or eliminates the need for separate liquid cells for each nozzle. In turn, this suppresses the sensitivity of jet or droplet projection to bubbles in the liquid which, in cell-based designs, can become trapped in those cells to provide continuing perturbation of jet and/or droplet projection.

The current invention also allows the high accuracy components to be concentrated in, at most, a few, sheet-like layers. This allows ease of fabrication since the piece parts are assembled onto a single plane.

The liquid projection apparatus described herein is believed by the inventors to be unique in the ability to deposit, white, gold and silver inks, and other inks of large pigment size and unstable dispersion characteristics, due to the unique ultrasonic action of the transducer means.

In addition, the action of the motional drive of at least the nozzle regions allows the device to perform an ultrasonic cleaning action of at least those regions of the transducers, including the inner and outer faces of those regions and of the nozzles themselves. This allows maintenance with reduced need for purging and wiping of the face of the device.

Advantageously, the excitation of the transducer can substantially localise the stimulation pressure to that liquid directly in contact with the nozzle region. This can be achieved by, for example, making the nozzle region less stiff to bending motion than the rest of the transducer, so that the greatest motional response (and thereby the greatest stimulation pressure) occurs in the nozzle region itself.

This means that in the new liquid projection device a very sharp resonance is not necessary and the liquid projection is thus further less sensitive to factors such as the consistency of the liquid, the presence of air bubbles in the liquid and manufacturing tolerances of the device, which generally have a very serious effect on the performance and cost of a conventional liquid projection device. The new liquid projection device is therefore potentially cheaper and more reliable in operation than the prior art and does not require such complicated liquid conditioning apparatus.

Advantageously, the thickness of each transducer in the motional direction satisfies the inequality:

$$\sum\left(\frac{t_i}{c_i}\right) < \frac{1}{2f}$$

where t, is the thickness of the rth layer of material in the transducer and c, is the speed in that layer, at the operating frequency f, of either compressional or shear waves propagating the layer in the direction of its thickness.

Other excitation means than piezoelectric elements suitable for use with the invention are electrostrictively, magnetostrictively and electrostatically deflected electromechanical elements.

In one example embodiment, piezoelectric elements are used as the excitation means, exciting motion of material layer(s) bearing nozzles responsive to an electric field applied to those elements. The elements are in the form of thin layers of piezoelectric material having electrodes on opposing faces. When pre-formed as fired elements, one such face of each piezoelectric element is mechanically bonded to a part of the nozzle-bearing material layer. When a refractory nozzle-bearing layer material (such as ceramic) is used, the piezoelectric elements may alternatively be deposited as a thick film (for example by screen printing) and fired in situ to form the excitation means. In both cases the piezoelectric layer is arranged to expand or contract on application of a voltage to it. Thus each element in combination with that area of the nozzle-bearing material layer to which it is bonded cooperatively form a transducer in the form of a flexural member. A nozzle formed either in this bonded area or in a nearby area of the nozzle-bearing layer thereby completes formation of a nozzle-bearing transducer. Both nozzle-bearing transducers and non-nozzle-bearing transducers can thereby be excited into bending motion substantially perpendicular to the electroded surfaces of the piezoelectric element and of the transducer as a whole. This provides, as a first advantage, motional excitations of the transducer and the nozzle-region within it, in a simple and efficient manner.

A second advantage resulting from this embodiment is that the exciting part of such a nozzle-bearing transducer structure (in this case the piezoelectric element and the region of the nozzle-bearing material layer to which it is bonded) can have a much lower acoustic impedance than in a conventional liquid projection device, the acoustic impedance of this exciting part being comparable to that of the nozzle region (and the same impedance if the nozzle lies within the exciting part). These circumstances mean that the amount of excitational energy stored in such a transducer is smaller than that stored in conventional devices and that a larger amount of energy can be transferred during excitation in either direction between the exciting part and the nozzle region. This makes it possible to control the excitation of the nozzle region directly by feeding appropriate drive signals to the excitation means, so allowing unwanted motions to be actively suppressed.

The isolation of one transducer from another (reduction of crosstalk) may be improved by fabricating transducers separated by gaps, or by locally removing material to form gaps within layers that are common to other transducers, particularly other adjacent transducers, thereby reducing the mechanical coupling between them. This may be achieved, for example, by grinding or by laser cutting, the latter advantageously allowing the fabrication of narrow slots of approximately 5 microns width, producing well-defined slits, free of blade "run-out".

The transducer may include an additional substrate (preferably, but not necessarily, in the form of a layer) on which said excitation means is mounted, said substrate having an aperture, and a flexible membrane mounted on said substrate and covering said aperture, wherein said nozzles extend through the region of the flexible membrane that covers said aperture. In such a construction employing a separate substrate and flexible membrane, the flexible membrane may be bonded to the substrate which may be formed of, for example, stainless steel.

In many applications of the present invention it is desirable to arrange the multiple nozzles in an array (or series of arrays) each being individually addressable by the excitation means of its respective transducer. These arrays of nozzles may be formed to define a common outer surface which surface may conveniently be coincident with the outer face of a common nozzle-bearing layer. In this case, preferably, the shape and location of the, or each, excitation means and transducer is arranged to avoid generating travelling waves which transfer energy between transducers from one nozzle to another, so mechanical crosstalk is minimized. This may be achieved for example by forming slits (described above) in the nozzle-bearing layer and/or in any auxiliary material layers employed.

Further refinement may be achieved by providing sensing means separate to or integral with the excitation means of nozzle-bearing transducers and by using feedback from the sensing means to nullify the background noise. Similarly, transducers without nozzles may alternatively or additionally, be excited to provide motional or pressure damping or cancellation in the nozzle regions of nozzle-bearing transducers. For this function such transducers without nozzles may beneficially be interspersed between nozzle-bearing transducers to form an alternating array. Indeed, benefit may be found even by the provision of simple 'passive elements' between nozzle-bearing transducers, these 'passive elements' typically comprising nozzle-less transducers that also have no excitation means or no drive provided to any excitation means that they do possess.

The nozzle-bearing layer may be mounted on a manifold having a cavity for supplying ink to at least the nozzle regions. The manifold may include excitation damping materials or otherwise be designed to inhibit resonance and, by extending across all or several nozzles can avoid the 'cell' construction of most conventional ink-jet printheads with their associated sensitivity to air bubbles and solids deposition.

The liquid projection device may also be formed as a piecewise fabrication of preformed components. This advantageously allows the choice of boundary conditions for the transducers, the pre-testing of component parts and the employment of further layers for nozzle regions and sealing structures between transducers.

Preferably, the device includes an electronic drive coupled to the terminals and hence to the transducers, and arranged to provide drive signals independently to respective transducer terminals, whereby production of droplets from the nozzles is achieved selectively by corresponding selective generation of drive signals.

Figure 2:
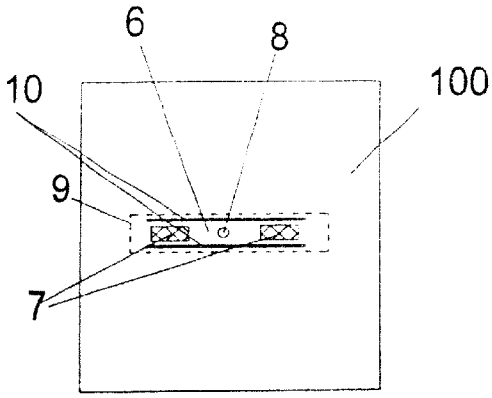
Figure 1B:
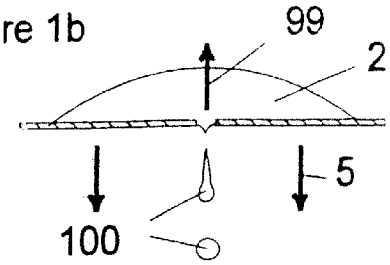
Figure 3:
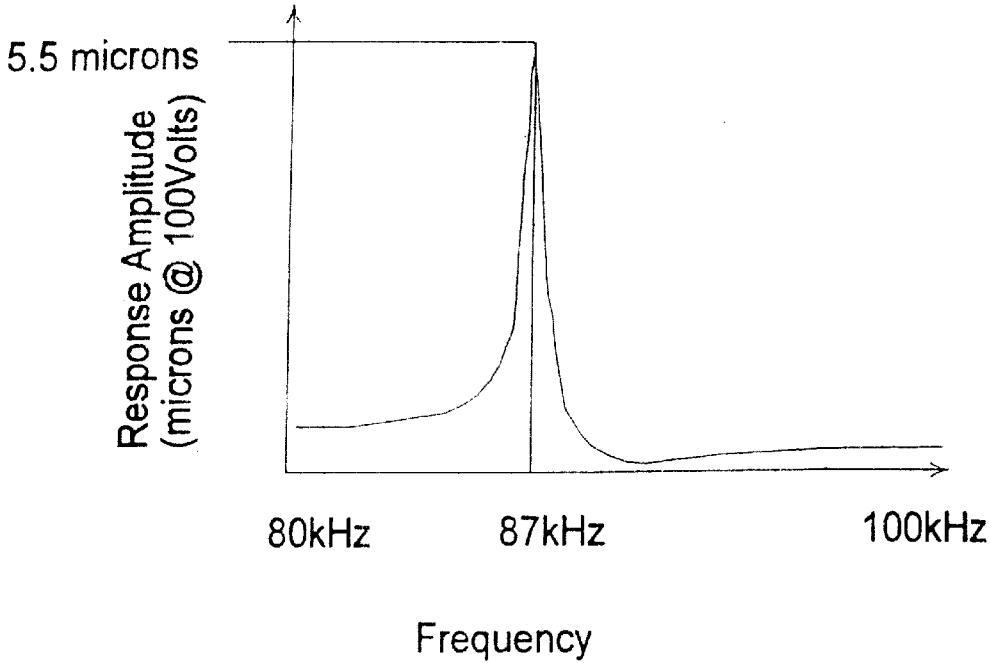
Figure 4:
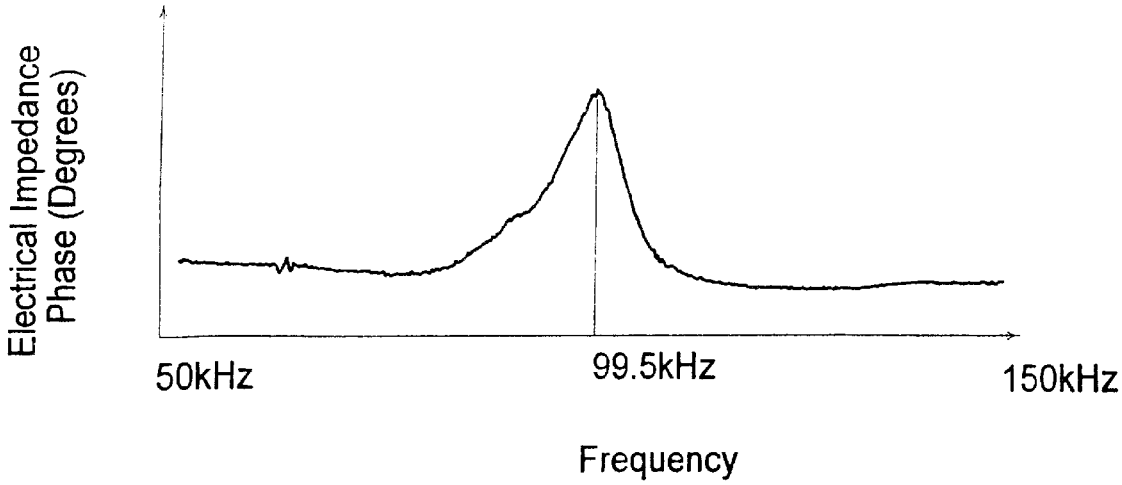
Figure 5A:
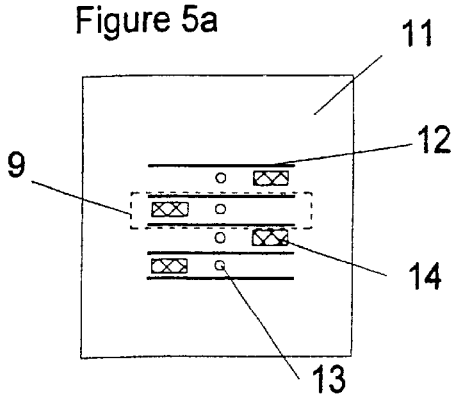
Figure 6A:
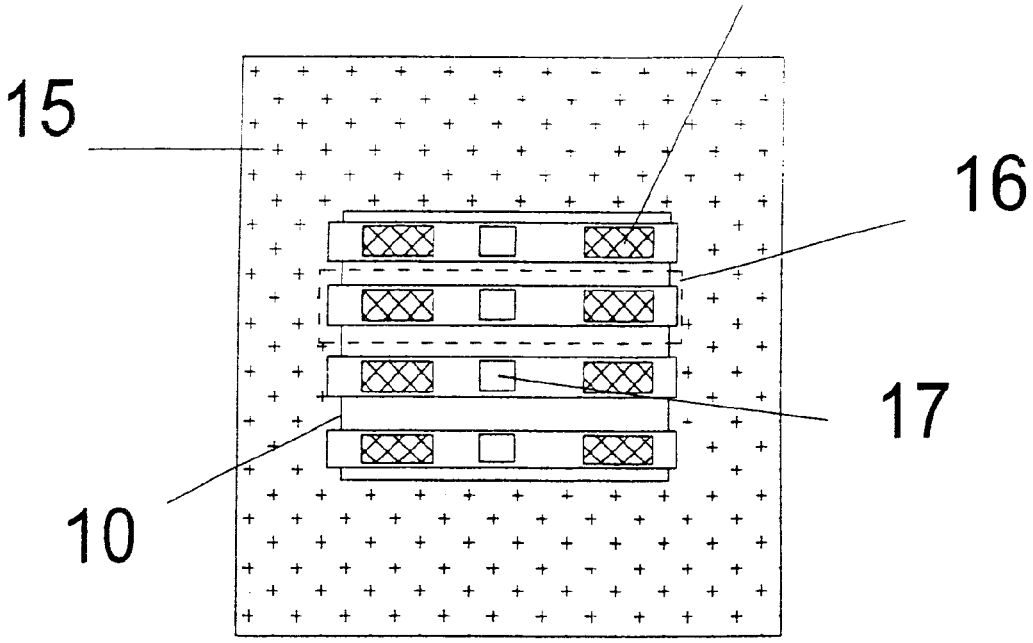
Figure 7:
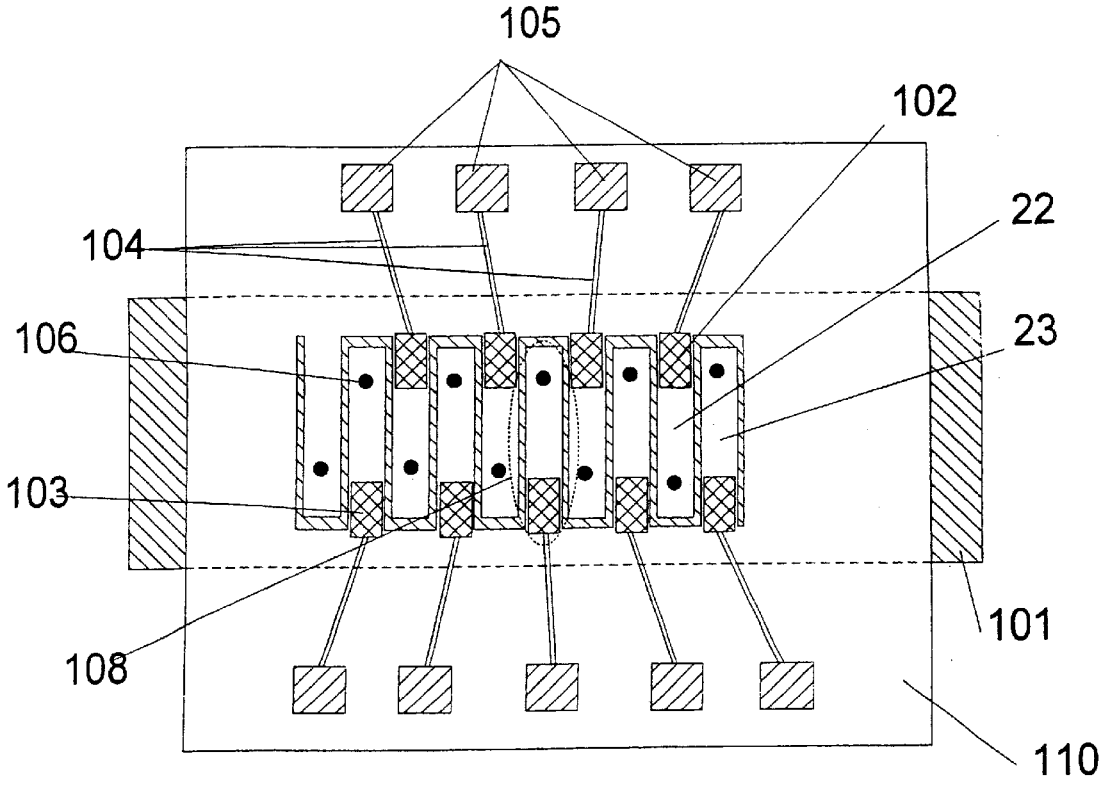
Figure 8:
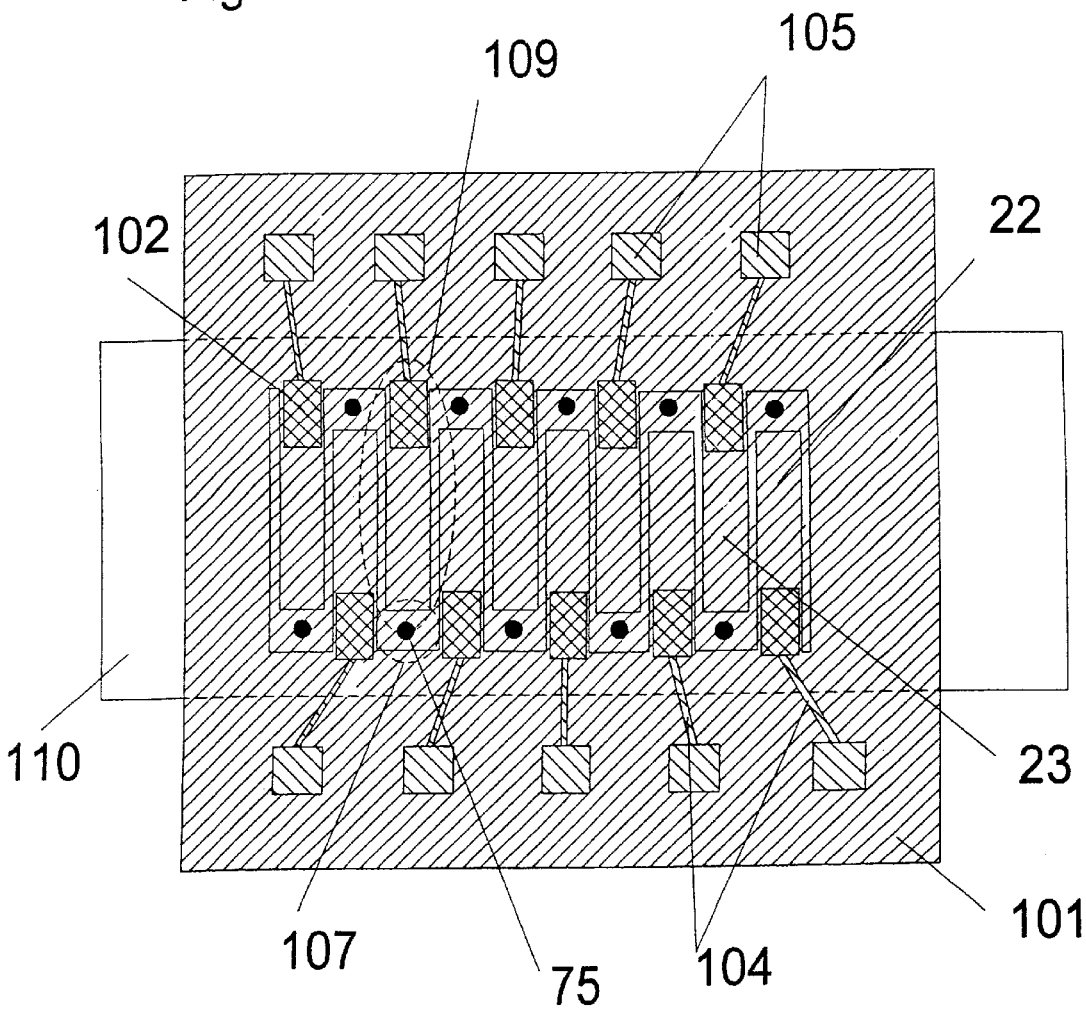
Figure 9:
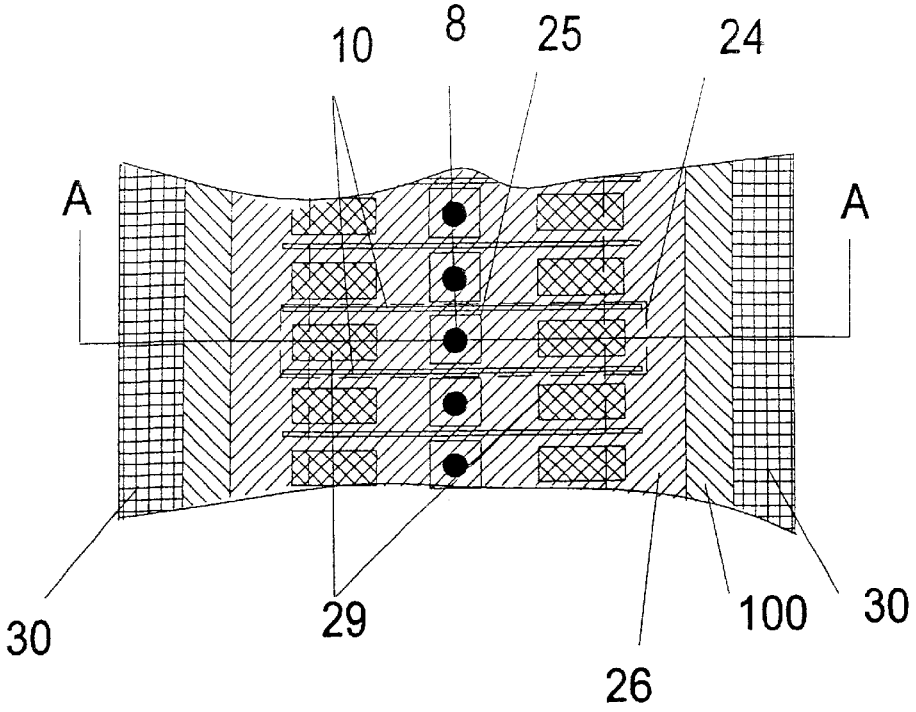
Figure 10:
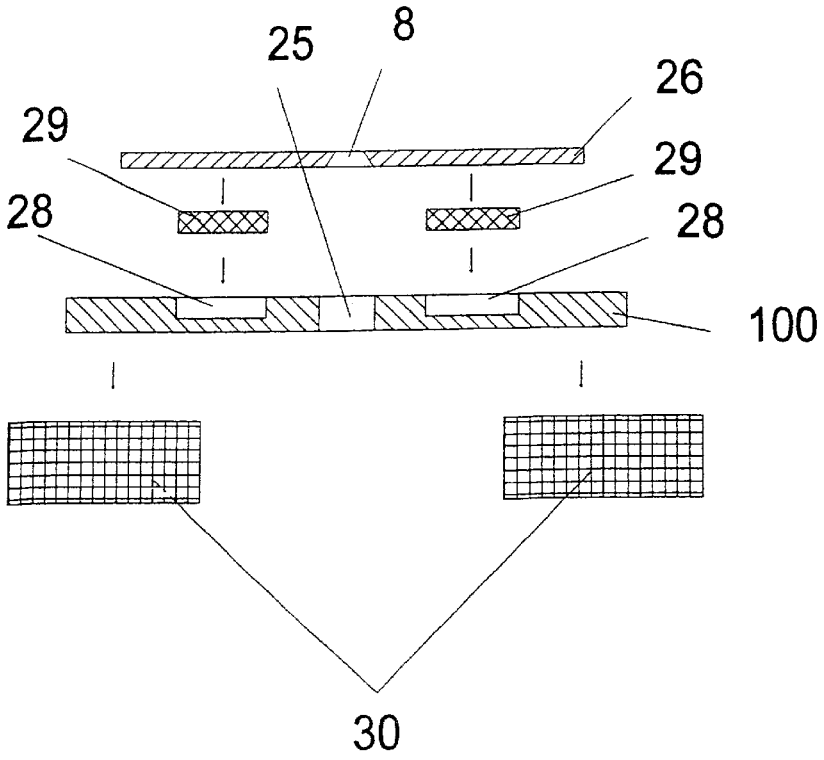
Figure 11:
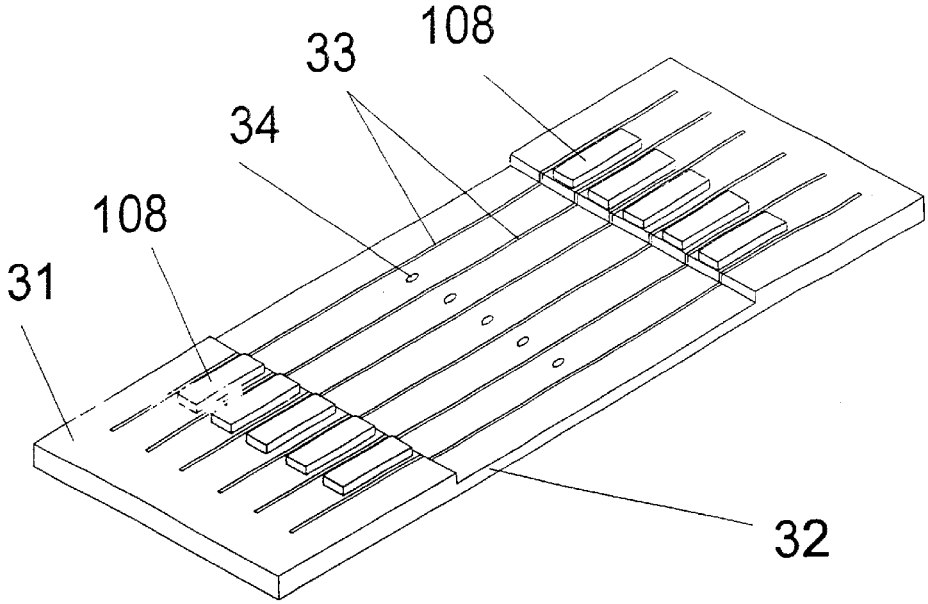
Figure 12:
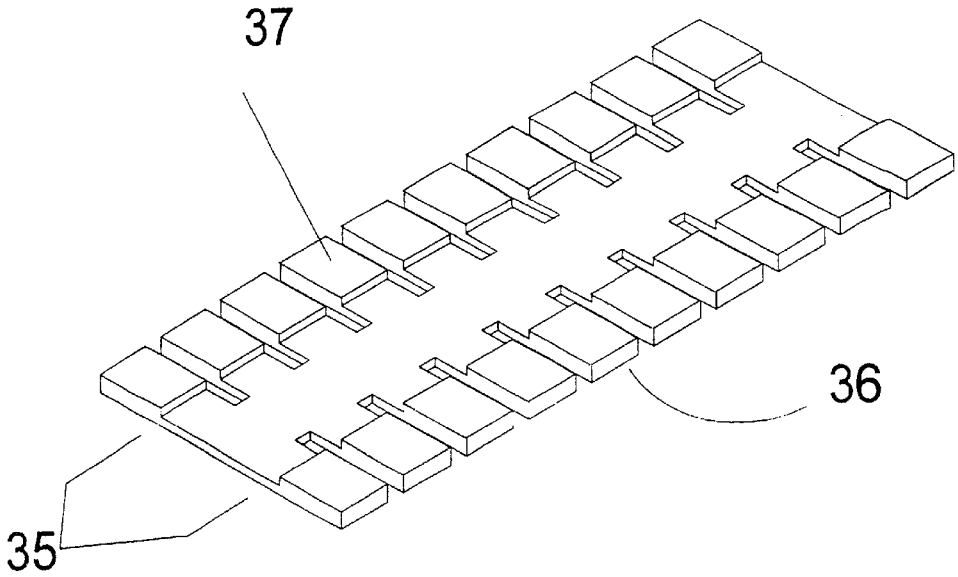
Figure 13:
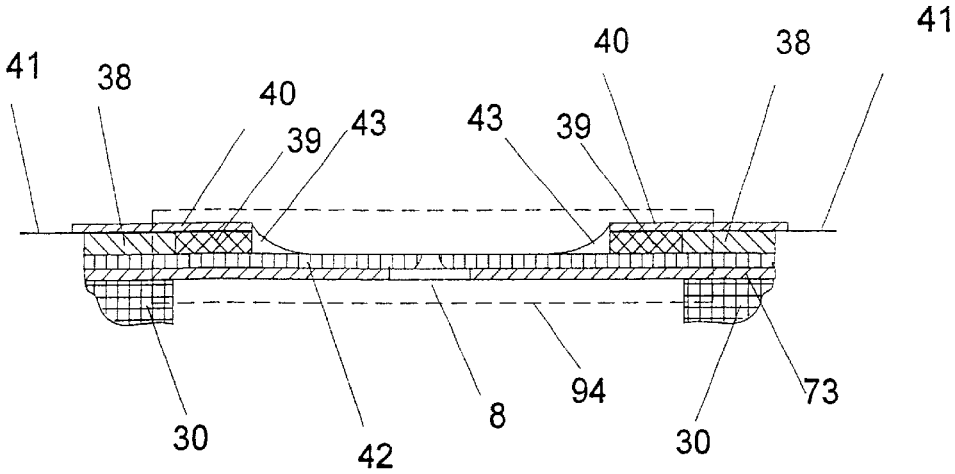

A number of examples of devices constructed in accordance with the present invention will now be described with reference to the accompanying drawings, which include:

FIG. 1*a* a cross-section of a device illustrating, in simplified form, the principle of operation during a push stroke;

FIG. 1*b* a cross-section of a device illustrating, in simplified form, the principle of operation during a pull stroke;

FIG. 2 a plan view of a first device;

FIG. 3 Finite Element modelling result for frequency response function of the first device;

FIG. 4 a graph of an experimental frequency response function of the first device;

FIGS. 5*a, b, c* plan views of three further examples;

FIGS. 6*a, b* plan views of two further examples of constructions using piecewise assembly methods;

FIG. 7 a plan view of a device having an interdigitated cantilever beam construction;

FIG. 8 a plan view of a further device having an interdigitated cantilever beam construction;

FIG. 9 a partial plan view of a device constructed using multiple material layers;

FIG. 10 a cross-section of the device of FIG. 9;

FIG. 11 an isometric view of a further device embodying selective thinning of the transducer beams;

FIG. 12 an isometric view of a PZT fabrication for use in a device according to the invention FIG. 13 a cross-section of a device incorporating the PZT fabrication of FIG. 11

Figure 14:
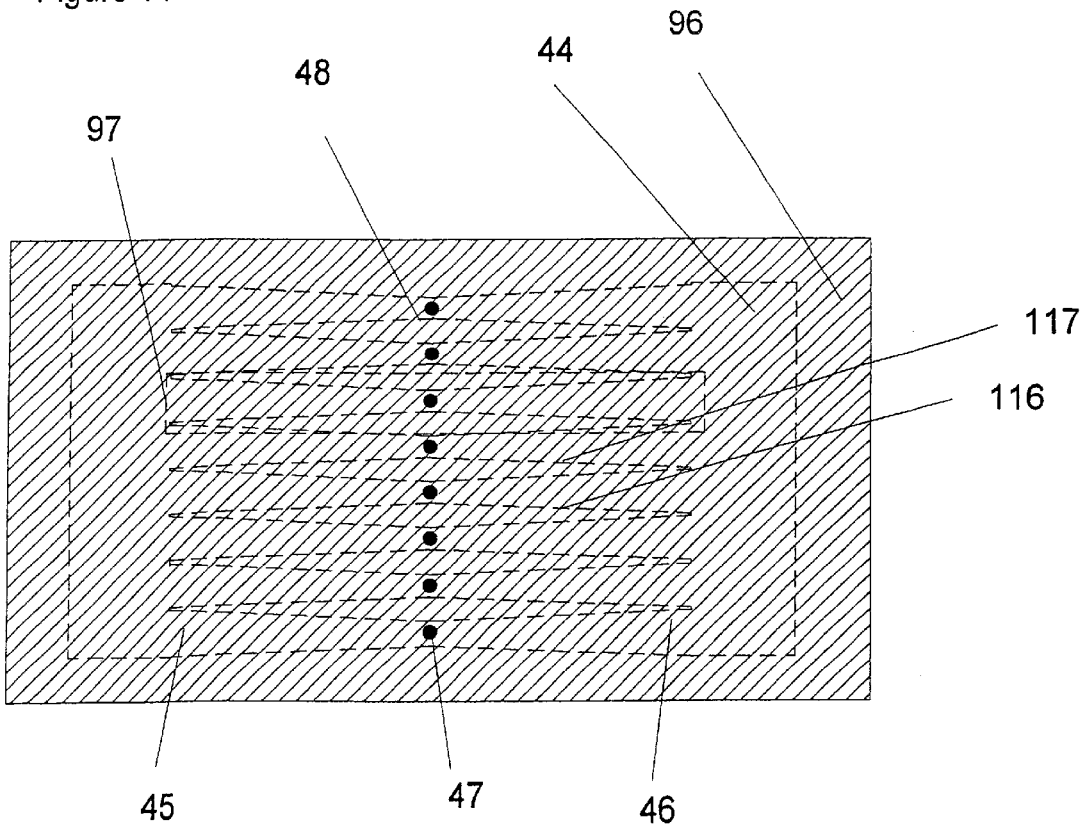

FIG. 14 a plane view of a construction having tapered beams

Figure 15:
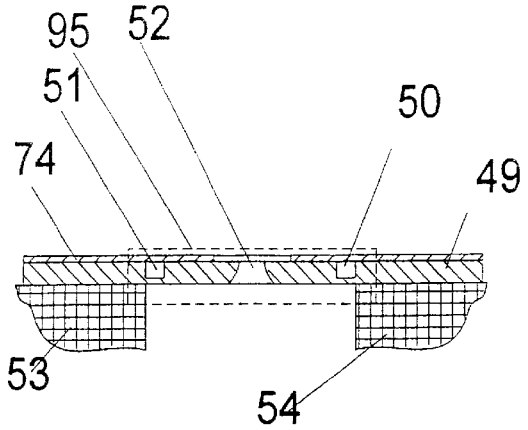
Figure 16:
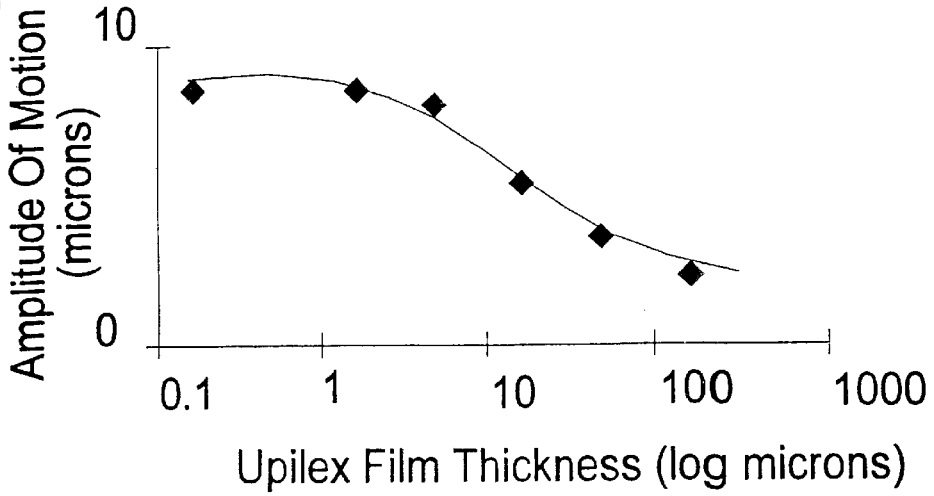
Figure 17:
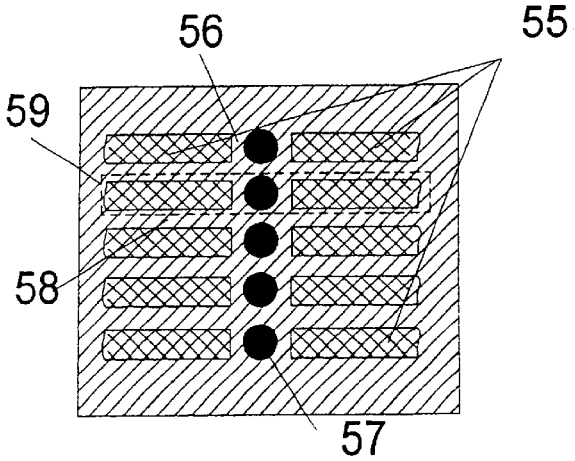
Figure 18:
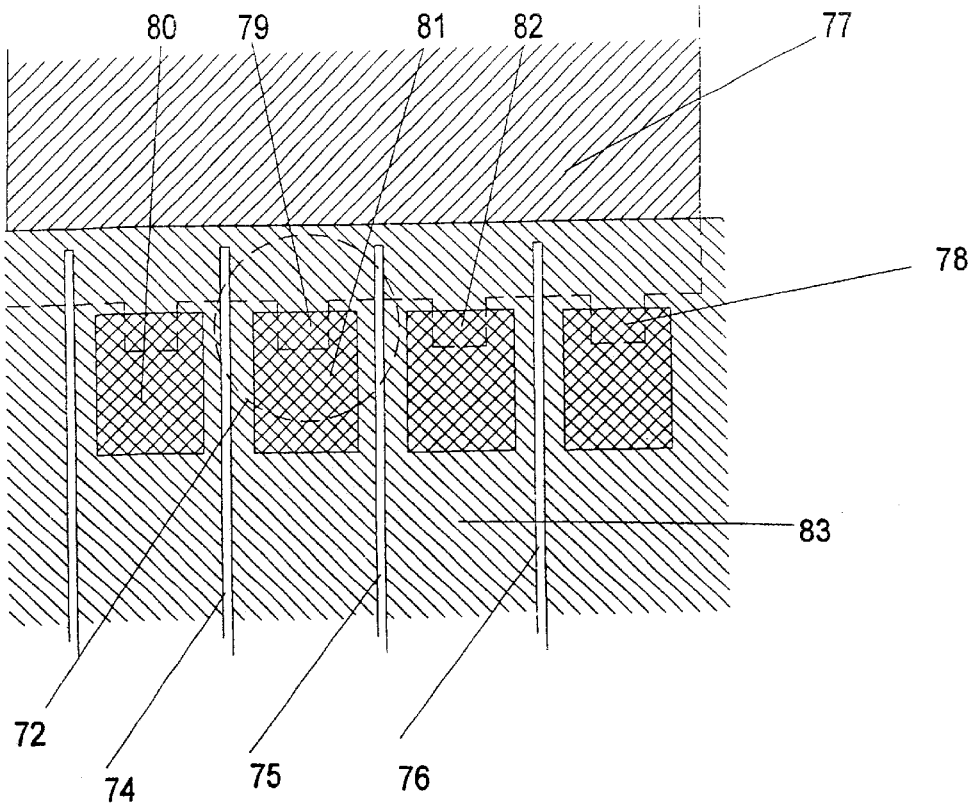
Figure 19:
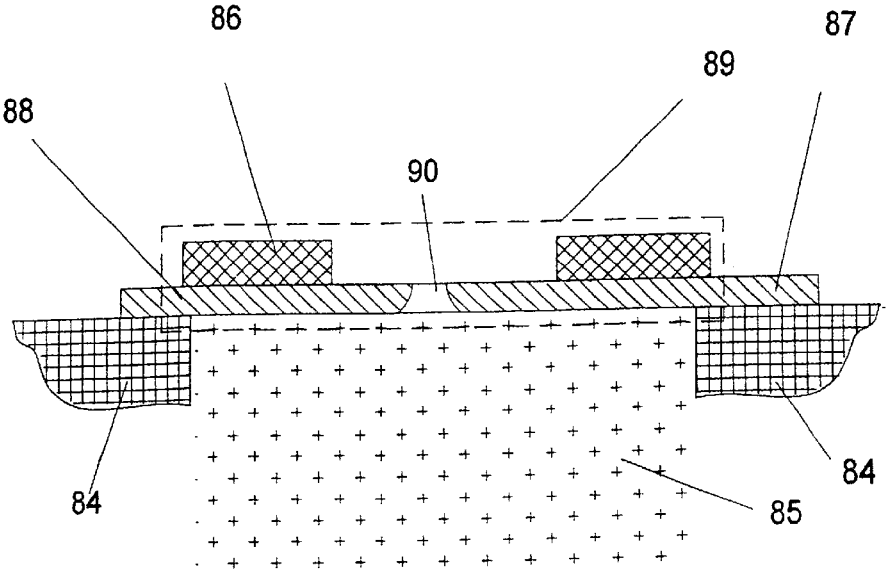
Figure 20:
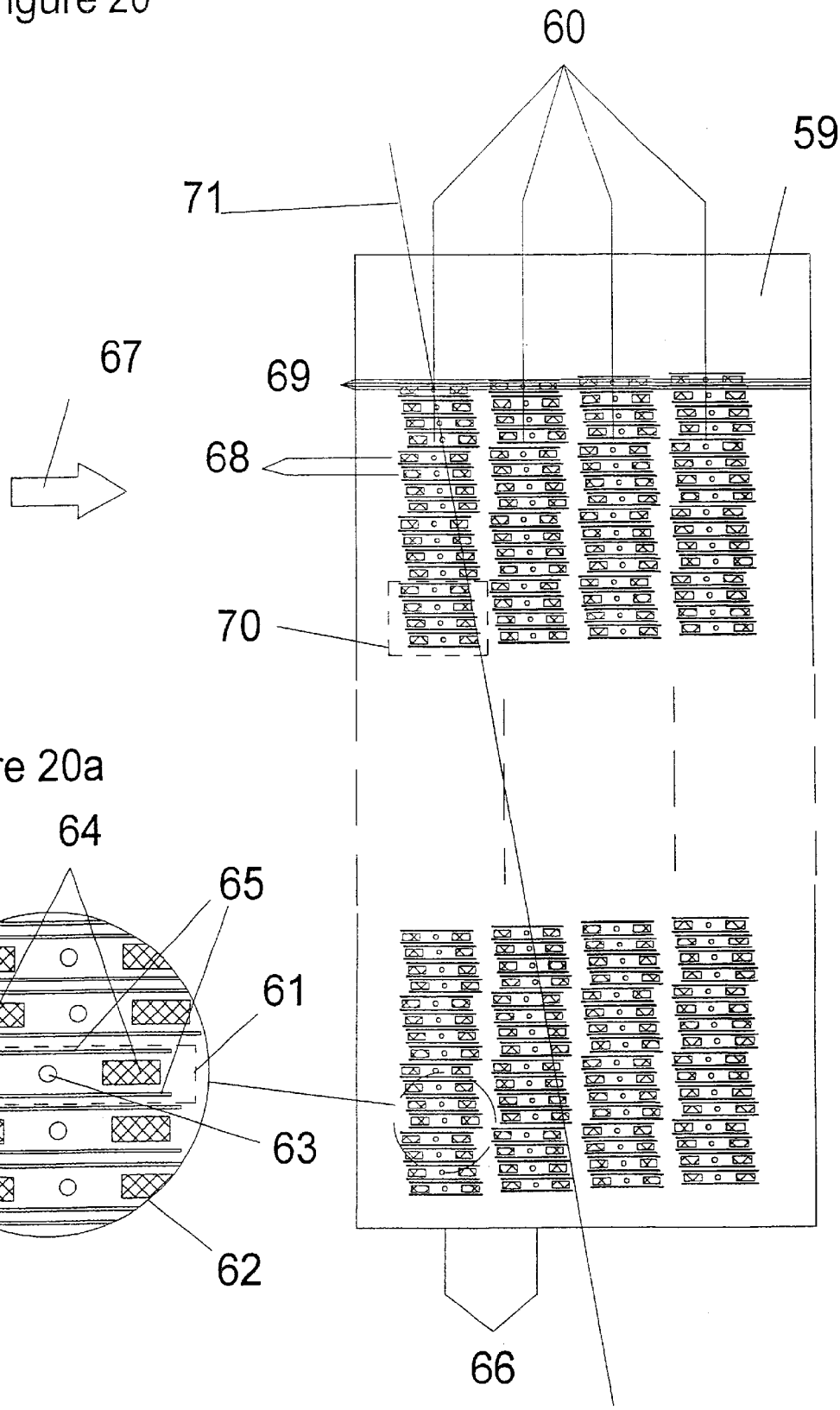
Figure 20A:
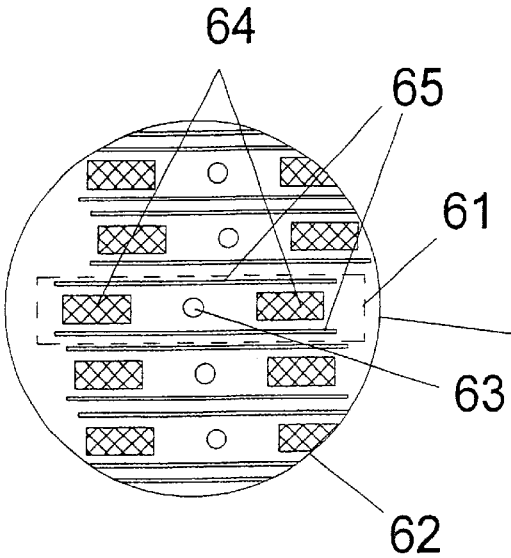
Figure 21:
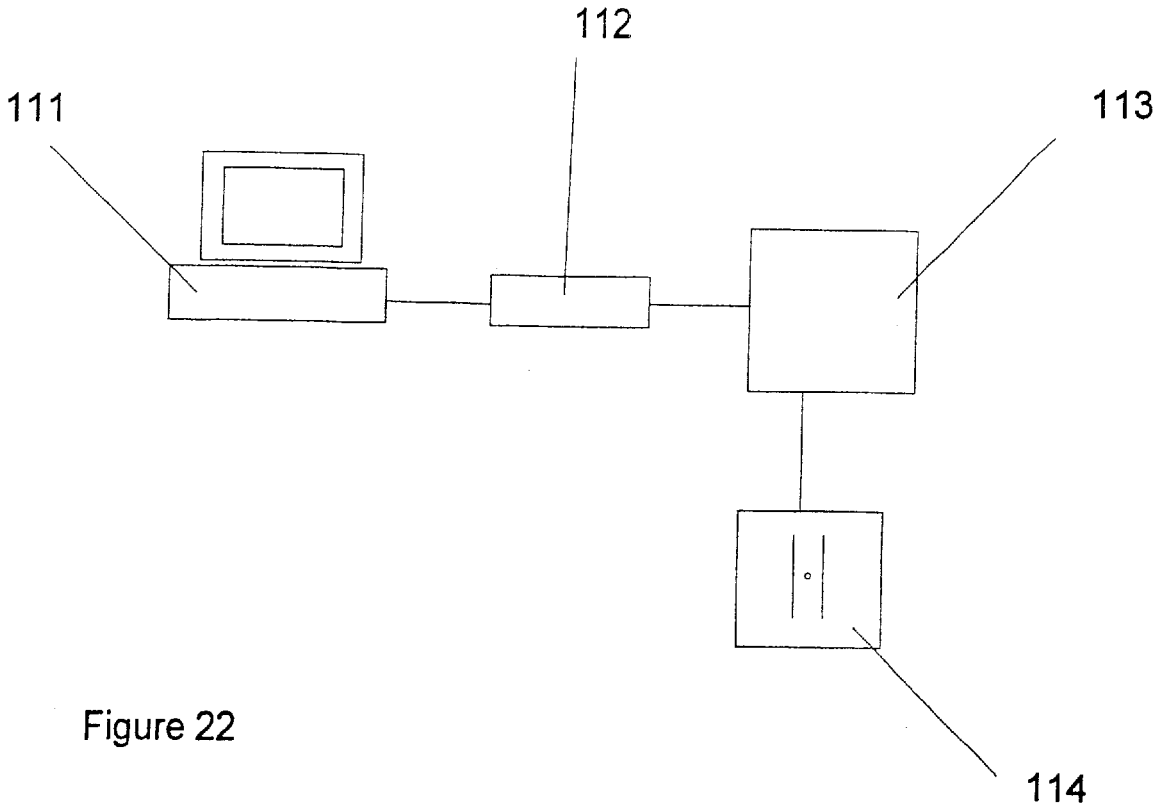

FIG. 15 a partial cross-section of a device having a slotted PZT construction;

FIG. 16 Finite Element modelling results with variable thickness of sealing layer;

FIG. 17 a plan view of a still further example;

FIG. 18 a plan view of a layered construction with additional support at the ends of PZT elements;

FIG. 19 a partial cross-section of a further example;

FIG. 20 a plan view of a device having a two-dimensional array of nozzles;

FIG. 20*a* a plan view of a magnified portion of the device of FIG. 20;

FIG. 21 a schematic of a device configuration; and

Figure 22:
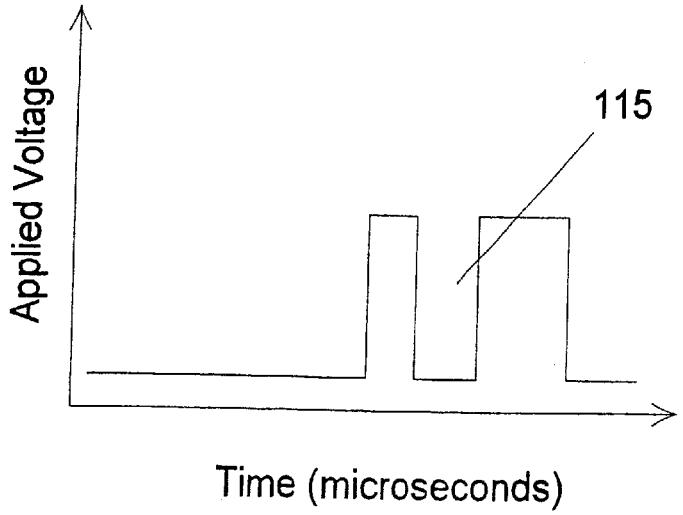

FIG. 22 a schematic graph of a suitable drive waveform.

FIG. 1 a shows nozzle-bearing members 1 formed in thin material layers, so providing extremely short inertial and viscous effective lengths for flow of liquid 2 through nozzle 8 in direction shown at 98 to form the emergent liquid 3 responsive to motion shown at 4 that induces positive pressure excursions in liquid 2. FIG. 1*b* shows flow of liquid 2 in direction shown at 99 responsive to the motion shown at 5 that causes negative pressure excursions in liquid 2, in turn causing the emergent liquid 3 to form emergent droplets shown at 100. This, together with the ability of devices according to this invention to provide pressure excursions of time duration in the region of one micro-second to one milli-second, advantageously allows liquid projection at very high frequencies.

One example embodiment, which has been reduced to practice, of a single transducer of the overall array device, is shown in plan view in FIG. 2. This illustrates a transducer 9 incorporating a 'beam' 6, with, for example, two piezoelectric elements 7 formed of PZT per nozzle 8. Nozzle 8 penetrates through material layer 100. This construction can provide a nozzle hole 8 mounted precisely at the motional antinode of the transducer, giving a symmetric pressure distribution in the sub-region of the nozzle hole. The transducer 9 is distinctly formed, in this case, by the introduction of slits 10 into material layer 100.

In this example as an operating liquid projection device, material layer 100 is electroformed nickel of 100 micron thickness and bearing a nozzle of exit diameter 25 microns. The slits 10 were formed by electroforming and are of width 20 microns; slit length is 9 mm, and the distance between the slits 10 is 1 mm. The piezoelectric components 7 each have width 0.8 mm, length 1.5 mm, thickness 200 microns, and are formed of piezoelectric ceramic P5 sourced from Ceramtec of Lauf, Germany providing high piezoelectric constants and mechanical strength. The electrode material applied to said piezoelectric components 7 was sputtered nickel-cobalt-gold, of thickness in the region 2–5 microns. This allowed cutting action with negligible damage to the PZT material or slitting saw. This also allowed electrical connections to be made to the transducers using 30 micron diameter aluminium wire, using an ultrasonic wire-bonder. The piezoelectric components 7 were bonded to nozzle-plate 100 using adhesive Araldite 2019 supplied by Ciba-Geigy, UK.

Continuously stimulating excitation of the beam motion alternately in each direction at the resonant frequency allows such a device to eject a continuous stream of droplets. The device above produced a continuous droplet stream when excited by an alternating square-wave voltage of 120 Volts peak to peak, at a frequency of 95.8 kHz.

By stimulating excitation with only one or a discrete number of such cycles allows the device to eject droplets 'on demand' i.e. responsive to that short droplet-projection pulse or pulse train, and ceasing after that pulse train ceases. The device described above was operated with a drive voltage of 150V peak to peak and with a base frequency 97.3 kHz. This device yielded a maximum 'on-demand' ejection frequency of 4 kHz. With other devices of this general form, on-demand frequencies of up to 10 kHz have been observed with a drive voltage 40V peak-to-peak.

Using water-based ink, at a supply bias pressure from 0 to −30 mbar, the device was demonstrated operating in drop on demand mode. This liquid projection apparatus whose fabrication was described above was mounted onto a manifold to provide liquid supply means and in proximity to printing media to form a system suitable for ink-jet printing. It was found experimentally that no sealant was needed in order to prevent egress of fluid from the slits, although for long-term reliability a sealing layer would be necessary.

The motional response peak for the device of FIG. 2 as a function of frequency, as predicted by finite element modelling, is shown in FIG. 3, and is typically broad. The frequency scale runs from 80 kHz to 100 kHz, showing a predicted maximum amplitude at frequency 87 kHz. It also shows the absence of unwanted vibrational modes near to the desired operating frequency.

FIG. 4 shows the result of experimental measurement of the electrical impedance phase using a HP 4194 impedance spectrometer. The frequency sweep runs from 50 kHz to 150 kHz, and shows that the only resonance in this range is the broad peak centred at 99.5 kHz.

In alternative constructions for the example of FIG. 2, unimorph (single layer) and bimorph (double layer) geometries may both be employed for the excitation means shown at 7. The thickness of the region of material layer material 100 near the ends of the slots is chosen to control the resonant frequency of the device.

Being substantially isolated by slits 10, arrays of such transducers allow substantially independent control of drop ejection from an array liquid projection device such as an ink-jet printhead.

Figure 5B:
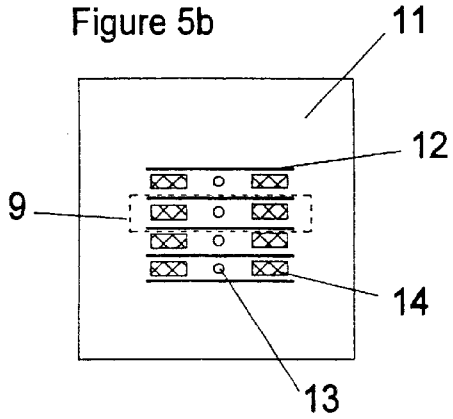
Figure 5C:
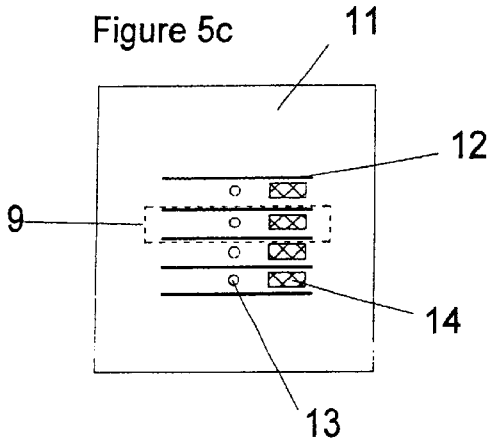

FIGS. 5*a*, 5*b* and 5*c* illustrate optional constructions wherein multiple nozzle-bearing transducers 9 are formed within the material layer 11, their lateral extent being defined by slits 12. Each such transducer bears a nozzle 13 through layer 11. FIGS. 5*a*, 5*b* and 5*c* differ in that they illustrate a variety of permutations of excitation means configuration 14, as shown.

The device may also be constructed from an assembly of pre-formed transducers (nozzle-bearing or otherwise) in the form of one or more linear arrays with a choice of excitation mode and acoustic boundary conditions available, including fixed-free (cantilever) or fixed-hinged, or fixed-fixed boundary conditions. Separate transducers may be assembled with fixed-free, fixed-fixed, hinged-fixed, or hinged-hinged boundary conditions, as appropriate to achieve the desired resonant conditions. Here, the terms 'hinged' and 'pivoted' are treated as synonymous, as are the terms 'clamped' and 'fixed', as is customary in acoustic theory.

Figure 6B:
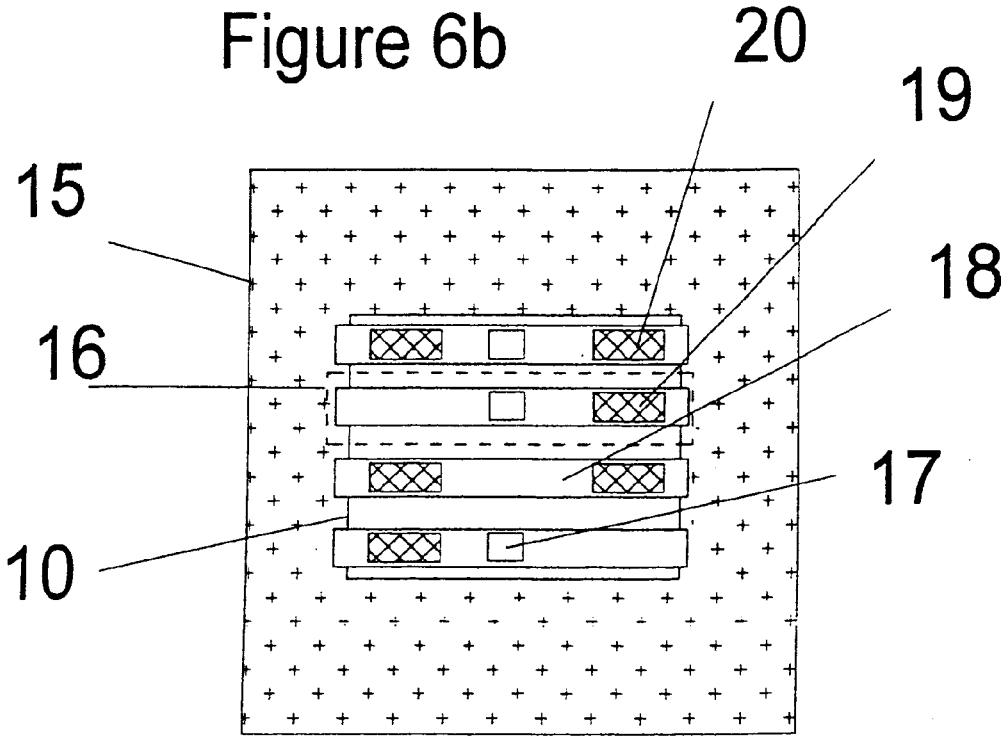

Such an assembly of pre-formed regions is shown in FIGS. 6*a* and 6*b*, wherein the material layer 15 having an aperture (or apertures) 10, forms a base for the attachment of transducers 16 (including excitation means 20) which may themselves include pre-formed apertures 17, or be left blank 18, so that these blank members may be used as active crosstalk compensation means, as shown with reference to excitation means 19. To apply the illustrated means as liquid projection apparatus, the apertures 17 and interstitial regions between transducers 16 (and between transducers 16 and plate 15) are themselves sealed by a further layer in which nozzles are formed in regions corresponding to apertures 17, or may themselves be formed as nozzles.

FIG. 7 shows an assembly constructed out of a material layer 110 in which two sets of cantilever beams are formed as interdigitated combs 22 and 23, the teeth of the combs providing flexural nozzle-bearing transducers. The combs are formed in a material layer 110 bonded to a sealing layer 101. In embodiments where the material layer 110 is formed of excitation material such as piezoelectric material, local areas 102, 103 of that material can be electroded and activated in those regions by the use of pattern-track 104 and pad connections 105 formed on the material layer itself. Nozzle means 106 can then be formed through the flexural transducer 108 or sealing layer 101. The pad connections can be arranged to accept the array contacts from driver integrated circuits advantageously eliminating the need for high density electrical connections to the array of flexural members.

FIG. 8 illustrates a variation on the embodiment in FIG. 7, wherein the nozzle-region 107, as indicated by the dashed circle, is associated with, but not formed through the transducer (in this case a flexural transducer) shown by dashed line 109. This variation allows the flexible sealing layer 101 to incorporate the nozzles 75, which is advantageous when, for example, the formation of the nozzle through the sealing layer is simpler and more accurate than through the transducer material itself. In this case also, the material layer 110 bears only the cantilever beams 22, 23; the excitation means 102, pattern track interconnection 104, and pad connections 105 are formed on the nozzle-bearing and sealing layer 101.

In FIGS. 7 and 8, the sealing layer 101 may be formed of Upilex of, for example 25 micron thickness.

FIGS. 9 and 10 illustrate in schematic plan and section at AA respectively, the construction of flexural transducers, such as one indicated at 24 to be used within the overall array device wherein pre-formed slits 10 and aperture 25 in material sheet 100 and excitation means 29 are overlaid with a nozzle-bearing layer 26. This construction thereby allows separate nozzle fabrication and slit sealing means (shown as material layer 100 in FIG. 9), with the nozzle 8 advantageously located at the antinode of the motion of the flexural means.

The nozzle-bearing layer 26 overlaid on material sheet 100 which includes receiving pockets 28 for the excitation means 29, the structure then being bonded to a support means 30, that may also be used as part of a liquid supply means.

Nozzles formed in the construction of the liquid projection device may have cylindrical form or other form with tapered cross-section. The tapering of the nozzles may result in the opening at the inner face being smaller than the outer face which is a form well known in the art for ink-jet printing. Alternatively the opening at the outer face may be formed to be smaller than the opening at the inner face, providing different operating regimes as described in relation to aerosol applications in our granted patent EP-B-0732975 and co-pending patent application GB9903433.2.

The nozzle-bearing layer 26 or support layer 30 may advantageously be made of stainless steel. Chemical etching or laser ablation of this material allows a simple method for the fabrication of stress-free substrates with small and reasonably well-characterized nozzle holes.

In a further embodiment of a transducer suitable for use within the current invention, a construction is shown in FIG. 11 wherein the material layer 31 is formed from a plate of thickness large enough to give good coupling between the motion of the PZT and the flexural motion of the plate. The locally thinned regions 32 of that layer 31 give increased amplitude motion at the nozzle for a given voltage. Such an embodiment could be fabricated, for example, by electroforming.

The liquid supply pressure may be controlled or the volume of ink delivered restricted enabling the device to be stored empty in a capping and maintenance station. This advantageously reduces the effects of nozzle-blocking due to evaporation from the liquid menisci in the nozzles while the device is not in use.

Additional cleaning in the maintenance station may advantageously be achieved by ultrasonic vibration of the device using the excitation means at the normal operational frequency or at a separate frequency chosen to cause cleaning of the material layer. The vibration may alternatively be supplied by a separate excitation means which may be mounted on the maintenance station or supplied by separate excitation means used in operation for active damping located on or in the proximity of the material layer.

In the above embodiments the nozzles and slits may be alternatively formed in nickel by electroforming, the PZT may then be bonded onto the nickel. Alternatively, only the nozzle holes may be formed by the electroforming step, in which case, the slots may be laser cut though the nickel. In both cases a laser or grinding saw can be used to cut slots through the PZT. Use of electroformed nickel advantageously allows patterned resist techniques to be applied for the lithographic definition of slits and nozzles as a single or two stage process.

In designs wherein the nozzle-bearing layer is formed separately from a slit-sealing layer, the slit-sealing is preferably provided as a compliant membrane (or membranes) such as 25 micron thick Kapton, which seals the slits but leaves the nozzles open. This advantageously ensures that liquid is not ejected from the slits and prevents evaporation of liquid from the slits that could otherwise inhibit motion of the nozzle regions and/or their associated transducers.

Preferred fabrication routes are now discussed which advantageously provide good nozzle hole quality and narrow pitch between nozzles. Laser machining techniques, particularly excimer lasers and frequency-tripled pulse YAG lasers, can give good quality slits and nozzle hole quality in a range of materials. In practice we find that an excimer laser, in particular a Lambda Physik model Minex 30796 producing 300 mW power at 248 nm with 40 Hz repetition rate is well suited to the fabrication of nozzles and slits made in PZT. Good quality nozzle holes in PZT, with diameter 25 microns are machined in 10 seconds. Slits in PZT can be machined by scanning the device through the laser beam. The material ablation rate was found to be approximately 20 microns/sec or equivalently 0.5 microns/pulse. In large scale production, nozzles and slits of approximately one transducer per second could be fabricated using this fabrication route, with only a small contribution to the cost per nozzle of the print-head.

In a yet further embodiment, the structure may be achieved by the application of anisotropically etched silicon substrates, which advantageously provide; large nozzle taper angle (the 54.7 degree angle between the silicon 111 and 100 planes is convenient exposed by wet chemical etching with KOH solutions, this is well known in the art), giving ratio of 2:1 or higher between hole minimum and maximum diameters; improved channel-to-channel consistency; fabrication techniques commonly used in mass-production in the semiconductor industry.

In forming an array of such devices, individual transducers may be formed using from a monolithic or multilayer slab of excitation material such as a piezoelectric ceramic (PZT) layer. As shown in FIG. 12, a central groove 35 is first cut in a monolithic layer 36 of such material. This defines a common inner edge of all transducers 37 in the transducers array, the outer edge being formed by the periphery of the monolithic slab 36. The individual transducer elements 37 are then defined by cross-cutting the structure. This 'totem pole' structure is then inverted and bonded onto a further material layer so forming an array of flexural transducers. In the case where that material layer is a nozzle-bearing layer, this procedure advantageously aligns and places a number of transducers relative to nozzles in a single step. After bonding, the transducers are then separated from one another by one or more dicing cuts that remove the remaining material of central groove region.

A cross-sectional view of a transducer fabricated in this manner is shown by dashed line 94 of FIG. 13, encompassing PZT elements 39 bonded to a nozzle-bearing material layer 42. This structure is then prepared for electrical interconnect by the insertion of spacer material layer 38 (that preferably is of a material with a high thermal conductivity) behind the PZT elements 39. An interconnect and protective layer 40 with pattern tracked electrodes 41 is then bonded over 38 and 39 thereby providing individual addressing means to the PZT elements 39, the ground plane connection being provided by the material layer 42 (either directly if layer 42 is conducting, or by means of an electrode or electrodes pre-formed onto layer 42 if that layer is chosen of non-conducting material). A fillet 43 is then applied to the edge of the transducer elements, sealing them from contact with fluid protecting them from chemical or electrical attack of the electrodes and piezoelectric elements. That assembly may be bonded to an ink manifold 30 either way up, by choice. The slits may be sealed using the fillet material or by providing an additional sealing layer 73.

Alternatively, the PZT elements, interconnect and spacer layers and glue fillet, lie on the fluid side of the device, with manifold 30. This configuration also has the advantages of protecting the PZT from mechanical damage in use and provides a planar top surface for ease of device maintenance in capping, purging and cleaning. In either case, the fluid can act as coolant to the excitation components.

An alternative in the construction method of devices as shown in FIG. 13 is provided by using the interconnect and protective layer 40 as the locator for the PZT elements 37 which are first mounted to the layer 40 before being joined to the nozzle-bearing layer 42. The PZT may be formed into excitation elements by methods described earlier or alternatively be formed individually and put in position by pick and place machinery. Either of layers 42 or 40 can also be fashioned to support power drive micro-chips and surface mount electronic components as an integral part of the printhead. The PZT elements may be provided with wrap-round electrodes. This both eliminates the necessity for wire bonding (a higher degree of integration thereby being obtained) and allows the entire electrical component to be passivated and/or encapsulated (whereby the entire assembly is highly protected from chemical attack).

In application, there is inevitably some degree of variation in the characteristics of individual transducers within an array. This variability is undesirable as it leads to different performance characteristics between nozzles. Methods to reduce such variability between local regions therefore are of benefit. Such methods include: alteration of the electrode pattern of the excitation means of the transducer by, for example, selective laser ablation of the electrode; physical removal of material from the transducer, particularly of beam regions of the transducer thereby altering the frequency response of the said beam, by for example the action of laser light; physical removal of material from the excitation means by for example, micro-machining.

In a further embodiment (see FIG. 14), transducers, for example flexural transducers, are provided wherein the width of the transducer and the corresponding slit width between adjacent transducers vary along their length. In this embodiment the transducers 97 are therefore not rectilinear in form, but tapered toward either end 45, 46. The symmetry of the construction maintains the condition that the transducers in the array have at least one common edge in parallel, for example, edges 116 and 117. The tapers reduce the bending stiffness of the beams continuously towards the nozzle region which advantageously causes the bending of the beam to be enhanced in that region, increasing droplet production efficiency. The nozzle-bearing flexural layer 44, formed, for example, of piezoelectric ceramic, and bearing the transducers 97 has thickest width of 169 microns distally from the nozzles 47 as shown at 45, 46, and thinnest width of 84.5 microns proximal to the nozzles 47. The interstitial areas 48 between transducers 97 are sealed by compliant polymer material layer 96, such as 25 micron thick Upilex; which has the added benefit of acting to absorb crosstalk emanating from transducer to another when said transducers are individuals excited into motion. Nozzles 47 are formed through both transducer layers 44 and 96.

In a further embodiment, an example of which is shown in FIG. 15, a section through a flexural transducer 95 and support layer 53, 54 is illustrated wherein layer 49 is formed of PZT and is approximately 200 microns in thickness. In operation, voltage applied to the electroded surfaces (the outer face and inner face as defined by the passage of nozzle 52 therethrough) causes flexure of layer 49 substantially parallel and/or anti-parallel to the axis of nozzle 52, which flexure is enhanced by the introduction of regions (grooves) thinned by approximately 100 microns, at the distal ends 50, 51. The spacing between the two thinned regions is 2.0 mm, giving an operating frequency of approximately 90 kHz.

FIG. 16 shows Finite Element modelling results of the device illustrated in FIG. 15. The graph gives modelling results for 6 devices, each with different thicknesses of the polymer sealing layer 74, based on a construction which uses Upilex as the material for this layer. If the thickness of this layer is less than 10 microns, the amplitude of motion of the nozzle is constant at 8.5 microns peak-to-peak. If the thickness of the sealing layer is greater than 100 microns, the sealing layer damps the nozzle motion so that the nozzle amplitude is too small to give fluid ejection. The modelling shows that a layer of 25 micron thick Upilex will be suitable to seal the slits against fluid egress without inducing damping or crosstalk.

In the example illustrated in FIG. 15, the transducer is entirely formed from a single PZT layer, although the principle to be illustrated may be otherwise embodied according to variants given within this specification. The transducer 95 is mounted on a support layer. 53, 54, of, for example, stainless steel, acting to clamp the distal ends of the local region, and situated in correspondence to the thinned regions to maximize enhancement of the flexural motion. Again, the nozzle may be replaced by a simple aperture, and layer 49 may be overlaid by a further nozzle-bearing polymer layer 74 (the nozzles in registry with those apertures) that seals the slits between transducers, acts to protect the outer face of the layer 49, and provides interconnect.

Such a construction is illustrated in FIG. 17, employing a multilayer structure, wherein the flexural members 55 of the transducer 59 are divided in two parts, the nozzle region 56, with a nozzle therein 57, being formed in a separate sealing layer 58. The separate layer 58 serves to provide both a substrate for nozzle formation and a means of sealing between transducer elements. Such a allows the nozzle to form the largest transverse dimension within the structure and allows the slits to have width that is a significant fraction of the diameter of the nozzle. A further advantage of this realization is the larger damping effect for the reduction of crosstalk when a flexible polymer is used for the separate layer 58 with wider separation between transducers than attainable by a simple slit.

In FIG. 18, it is illustrated how a modification to boundary conditions at the distal portion of the transducers 72, 73 separated by slits, 74, 75, 76, may be afforded by the inclusion of a further stiffening layer 77. The layered construction of the micro-droplet deposition apparatus uniquely allows the optical alignment of this further stiffening layer. The further layer may be arranged such that tabs 78, 79 underlie their corresponding transducer components 80, 81 thereby stiffening the hinged or clamped join at the area of overlap 82, consequentially allowing the flexural layer 83 to be formed to be of comparatively lower stiffness than otherwise possible. The stiffening layer also advantageously prevents crosstalk between distal sections of the local regions by forming an acoustic barrier between them.

In FIG. 19, an embodiment is shown, comprising a section of a transducer 89, bearing a nozzle 90, in which the action of the further stiffening layer is achieved by the support layer 84, which also acts to contain the fluid 85. The excitation means 86 , in the illustration, overlies the material layer 87 in which the local regions are formed, and the excitation means is so placed that its distal end 88 overlies the support layer 84, thereby achieving the modification of the boundary constraint at the distal ends of the transducer substantially to the hinged condition.

A final embodiment is shown in FIG. 20, wherein the liquid projection apparatus is configured in a manner suitable for digital printing. The apparatus is constructed on a material layer 59, on which a two-dimensional array of transducer components are arranged in a number of lines 60. A detail of the transducer geometry 61 is shown in the inset 62 for clarity. The transducers are formed with a nozzle 63, excitation means 64 and are separated from one another by slits 65. In this embodiment the transducers are shown with two slits per transducer, in contrast to previously shown embodiments, although one slit could also be employed. The transducer array as shown is advantageously arranged such that the lower fabrication resolution spacing 66 is perpendicular to the print direction 67. The printing resolution of each line is thereby maximized to the spacing 68. The additional lines of the array 60, are staggered at a fraction of the spacing 68 (at one quarter of the spacing 68 in the case shown), and so allows the printing resolution to be further enhanced 69 by overlaying the print from separate lines successively. A final elaboration shown in this embodiment is the arrangement of a number of transducers on a sub-array 70, at an angle 71 to the lines of the transducers 60. The arrangement 70 allows the printing signal to the neighbouring transducers to be delayed in time with respect to the other transducers in the sub-array, so that any remaining crosstalk between neighbouring transducers are distributed in time. There are many permutations that could be envisaged in the relative placement of transducers within the sub-array, and the embodiment shown herein is only one example of such permutations.

A schematic layout of the electronic drive for the operation of the liquid projection apparatus is shown in FIG. 21. A personal computer 111 is shown running suitable software such as ETC M321 Generator Software produced by ETC s.r.o., Zilina, Slovak Republic which provides data to a corresponding drive card 112 such as a ETC M321 Generator card from the same supplier. The signals so produced are delivered via a custom made amplifier 113 to liquid projection apparatus 114 as described in the text. The drive signal is shown schematically in FIG. 22 wherein an the example wave-form 115 is illustrated. The typical peak voltage of this waveform is between 40 and 150 V.

What is claimed is:

1. A device for projecting liquid as jets or droplets from multiple nozzles, the device comprising:

a plurality of transducers oriented substantially parallel to one another and each having an inner face and an outer face opposite said inner face, the transducers being arranged in a substantially planar array;

a plurality of nozzles, each nozzle being associated with a respective transducer and having corresponding inner and outer faces and an axis normal to said inner and outer faces of said transducer, said transducer being excitable to cause movement of the associated nozzle in a direction substantially aligned with the nozzle axis, to project liquid therefrom;

liquid supply means for supplying a liquid to said inner face of said nozzles;

means for selectively exciting transducers as required, thereby to project liquid as jets or droplets from the respective outer face by movement of the liquid through the nozzle in response to the movement of the nozzle.

2. A device according to claim 1, wherein the transducers are formed in regions of a material layer having an outer face and an inner face, at least some of said regions having nozzle-bearing sub-regions through which nozzles extend from the inner face to the outer face, and including a multiplicity of excitation means, each capable of exciting at least one of said regions and/or nozzle-bearing sub-region.

3. A device according to claim 2, wherein said regions are in the form of beams formed by slits within said material layer.

4. A device according to claim 3, wherein each of the slits is sealed.

5. A device according to claim 3, wherein said slits are arranged in the form of a comb.

6. A device according to claim 5, wherein the slits are arranged in the form of two interdigitated combs.

7. A device according to claim 2, wherein terminals for supplying actuating signals to the transducers are formed in the material layer in which the transducers are formed.

8. A device according to claim 2, wherein a region of the material layer adjacent each transducer is thinner than other parts of the material layer.

9. A device according to claim 1, wherein the transducers are formed in regions of a first material layer which contains a plurality of apertures therethrough, the nozzles are formed in sub-regions of a second material layer in registry with the apertures in the first material layer; and including a multiplicity of excitation means, each capable of exciting said second material layer directly or indirectly in the sub-region of at least some of said nozzles.

10. A device according to claim 1, wherein the transducers are defined in a plurality of members supported on a substrate.

11. A device according to claim 1 wherein the transducers are flexural.

12. A device according to claim 1, wherein the transducers are formed in regions of a material layer having a thickness reduced from that of the remainder of the material layer.

13. A device according to claim 1, wherein the transducers are formed in a first material layer and separated from one another by a sealing layer, and the nozzles are formed in the sealing layer.

14. A device according to claim 13, wherein each nozzle is disposed between the ends of a pair of opposed transducers.

15. A device according to claim 13, wherein each nozzle is disposed at the end of a respective transducer.

16. A device according to claim 1, wherein the transducers comprise beams, each beam having a free end which is supported by a stiffening layer of material.

17. A device according to claim 1, wherein the transducers comprise beams, the side of each of which are tapered towards one another, the respective nozzles being located in the narrower portions of the respective beams.

18. A device according to claim 1, wherein a plurality of signal terminals are provided corresponding to respective transducers.

19. A device according to claim 18, further including an electronic drive coupled to the terminals and hence to the transducers, and arranged to provide drive signals independently to respective transducer terminals, whereby production of droplets from the nozzles is achieved selectively by corresponding selective generation of drive signals.

20. A device according to claim 1, including further transducers with which no nozzle is associated, whereby actuation of the further transducers can be employed solely to reduce crosstalk between adjacent nozzles.

* * * * *